US005827112A

United States Patent [19]

Ball

[11] Patent Number: 5,827,112

[45] Date of Patent: Oct. 27, 1998

[54] METHOD AND APPARATUS FOR GRINDING WAFERS

[75] Inventor: Michael B. Ball, Boise, Id.

[73] Assignee: Micron Technology, Inc., Boise, Id.

[21] Appl. No.: 990,616

[22] Filed: Dec. 15, 1997

[51] Int. Cl.[6] ..... B24B 49/18

[52] U.S. Cl. ..... 451/21; 451/10; 451/41; 451/56; 451/286; 451/449; 125/11.22

[58] Field of Search ..... 451/10, 11, 9, 451/21, 41, 56, 285–289, 443, 449, 450; 125/11.22

[56] References Cited

U.S. PATENT DOCUMENTS

| | | | |
|---|---|---|---|
| 4,016,855 | 4/1977 | Mimata . | |
| 4,227,347 | 10/1980 | Tam . | |
| 4,318,250 | 3/1982 | Klievoneit et al. . | |
| 4,344,260 | 8/1982 | Ogiwara . | |
| 4,478,009 | 10/1984 | Rukavina et al. | 451/14 |
| 4,662,124 | 5/1987 | Kato et al. . | |
| 4,663,890 | 5/1987 | Brandt . | |
| 4,693,036 | 9/1987 | Mori . | |
| 4,753,049 | 6/1988 | Mori . | |
| 4,773,951 | 9/1988 | Moffatt et al. . | |
| 4,852,304 | 8/1989 | Honda et al. . | |
| 4,894,956 | 1/1990 | Honda et al. . | |
| 4,947,598 | 8/1990 | Sekiya . | |
| 5,035,087 | 7/1991 | Nishiguchi et al. . | |
| 5,111,622 | 5/1992 | Steere, Jr. . | |
| 5,113,622 | 5/1992 | Nishiguchi et al. . | |
| 5,185,956 | 2/1993 | Steere, Jr. . | |
| 5,189,843 | 3/1993 | Steere, Jr. . | |
| 5,329,733 | 7/1994 | Steere, Jr. . | |
| 5,366,924 | 11/1994 | Easter et al. . | |
| 5,545,076 | 8/1996 | Yun et al. . | |
| 5,601,732 | 2/1997 | Yoshida . | |
| 5,607,341 | 3/1997 | Leach . | |
| 5,632,667 | 5/1997 | Earl et al. . | |
| 5,679,060 | 10/1997 | Leonard et al. . | |
| 5,679,212 | 10/1997 | Kato et al. . | |
| 5,700,180 | 12/1997 | Sandhu et al. | 451/9 |
| 5,733,176 | 3/1998 | Robinson et al. | 451/41 |

OTHER PUBLICATIONS

Model 7AG—Intelligent Wafer Grinder (Strasbaugh Literature).

*Primary Examiner*—Robert A. Rose
*Assistant Examiner*—George Nguyen
*Attorney, Agent, or Firm*—Dickstein Shapiro Morin & Oshinsky LLP

[57] ABSTRACT

A grinding machine for grinding a wafer includes a pressure sensing grinding wheel and a source of wheel dressing. Based on a pressure signal received from the grinding wheel, a contoller provides a control signal to the source of wheel dressing to release the wheel dressing to sharpen the grinding wheel. A method of grinding wafers includes the steps of grinding a wafer, receiving a signal indicative of the amount of grinding and controlling the release of wheel dressing in response to the signal. The controller can also receive signals from a spindle shaft speed sensor and a spindle motor current detector to determine when, and how much, wheel dressing to release.

18 Claims, 4 Drawing Sheets

METHOD AND APPARATUS FOR GRINDING WAFERS

This invention relates to a grinding machine, and in particular, to an automated wafer grinding machine. More particularly, the invention relates to an automated wafer grinding machine that automatically releases wheel dressing to sharpen a grinding wheel.

BACKGROUND OF THE INVENTION

As is known, the source material for manufacturing semiconductor chips is usually a relatively large wafer, for example, of silicon. A crystal ingot is sliced to a suitable thickness to obtain a number of nearly disk-shaped semiconductor wafers. Both surfaces of each wafer are subjected to abrasive machining, and then etched in a suitable mixed acid solution. One surface of each wafer is then polished to obtain a mirror surface. Circuits are applied to the mirror surface of the resulting semiconductor wafer by known processing steps of printing, etching, diffusion, doping etc.

The silicon wafers are sliced from the crystal ingot to a thickness that is greater than desirable for a finished integrated circuit product so as to provide a more robust wafer to stand up to the rigors of the integrated circuit fabrication processes. Particularly, relatively thick silicon wafers are necessary during the integrated circuit fabrication steps to prevent warpage and breakage of the wafer as a result of certain heating, handling and other circuit fabrication processes. However, the thickness of the wafer after the integrated circuits are fabricated is greater than desirable for device packaging restrictions. Therefore, it is necessary, after the integrated circuit patterns are defined, to grind a backside surface of the wafer opposite to the frontside surface of the wafer where the integrated circuits are formed to reduce the wafer thickness.

Suitable grinding machines are well known in the art that are capable of grinding down the backside surface of the silicon wafer. Known types of grinding machines generally include a plurality of chuck tables that secure a plurality of wafers to be ground by one or more grinding wheels. It has been found, however, that there are problems in the present wafer processing methods and apparatus. For example, conventional grinding machines move the grinding wheel at constant feed rate, occasionally resulting in increased loading, wafer breakage and an overheating condition that burns wafer tape used to protect the integrated circuit patterns. A grinding machine that sensed the downward force applied to the wafer would allow an adjustment of the feed rate in order to maintain a controlled force applied to the wafer. The application of a controlled force would result in a reduction in loading, less wafer breakage, and elimination of the overheating condition.

A conventional grinding wheel includes a plurality of diamonds embedded in a resinous binder, with some of the diamonds exposed and some unexposed. As the grinding progresses, the exposed diamonds wear down to the level of the binder. The binder is selected to erode during grinding to expose fresh diamonds. However, the rate of wear is totally dependent on the composition of the binder.

A grinding machine that sensed the amount of grinding of the wafer could release a controlled amount of wheel dressing in order to sharpen the grinding wheel, thereby improving grinding and reducing the pressure applied against the wafer. Feedback from the grinding machine would allow a determination of when, and how much, wheel dressing is to be released. The resulting controlled pressure would result in a reduction in loading, less wafer breakage, and elimination of the overheating condition.

Various machines have been suggested to control the forces applied to a wafer. For example, U.S. Pat. No. 5,035,087 to Nishiguchi et al. discloses a grinding machine that compares the shaft motor current and the rotation speed of the shaft with predetermined values to derive actual and desired grinding resistance values. The shaft speed is adjusted to bring the actual grinding resistance value closer to the desired value. U.S. Pat. No. 5,545,076 to Yun et al. discloses an apparatus for removing dust from a wafer during the grinding process that includes a controller for controlling the grinding device and a cleaning device. U.S. Pat. No. 5,607,341 to Leach relates to a method and apparatus for polishing a wafer. Leach discloses a plurality of blocks that move up and down in a grinding wheel. In one embodiment, a magnetic fluid is contained in the grinding wheel and cooperates with a magnet disposed below the wafer to apply a force to the blocks. However, none of these machines adjust the sharpness of the grinding wheel. Instead, they all adjust the grinding wheel dynamics to change the grinding rate.

SUMMARY OF THE INVENTION

According to the present invention, a method for dressing a grinding wheel comprises the steps of moving a grinding wheel into contact with the wafer, grinding the wafer, receiving a signal indicative of the amount of grinding, and controlling the release of wheel dressing in response to the signal. The signal indicative of the amount of grinding includes a signal indicative of at least one of the pressure applied by the grinding wheel against the wafer, the current draw of a motor drivingly coupled to the grinding wheel, and a rotational speed of the grinding wheel.

In preferred embodiments, the grinding wheel includes a disk portion and a grinding surface, and the signal indicative of pressure applied by the grinding wheel is generated by a pressure sensor disposed between the grinding surface and the disk portion.

A grinding machine for grinding a wafer comprises a grinding wheel including a grinding surface having a grinding material, such as diamonds, suspended in a binder. A first portion of the diamonds is exposed for grinding and a second portion is unexposed. A shaft is rigidly coupled to the grinding wheel and a grinding wheel drive motor is coupled to the shaft. A controller is coupled to a source of wheel dressing and is configured to receive a first input indicative of a current draw of the motor, a second input indicative of the speed of the shaft, and a third input indicative of pressure applied by the grinding wheel against the wafer. Based on the inputs, the controller provides a signal to the source of wheel dressing to control the release of wheel dressing which is used to release the worn diamonds and expose fresh diamonds for grinding.

It is therefore an object of the invention to provide a method of grinding a wafer.

It is another object of the invention to provide a method of sharpening a grinding wheel.

It is another object of the invention to automatically release wheel dressing to sharpen a grinding wheel.

It is another object of the invention to release wheel dressing in response to signals that are indicative of spindle shaft speed, spindle motor current draw and pressure applied against the wafer.

These and other objects, features and advantages of the invention will become apparent from the following detailed description of preferred embodiments of the present invention.

DETAILED DESCRIPTION OF PREFERRED EMBODIMENTS

Figure 1:
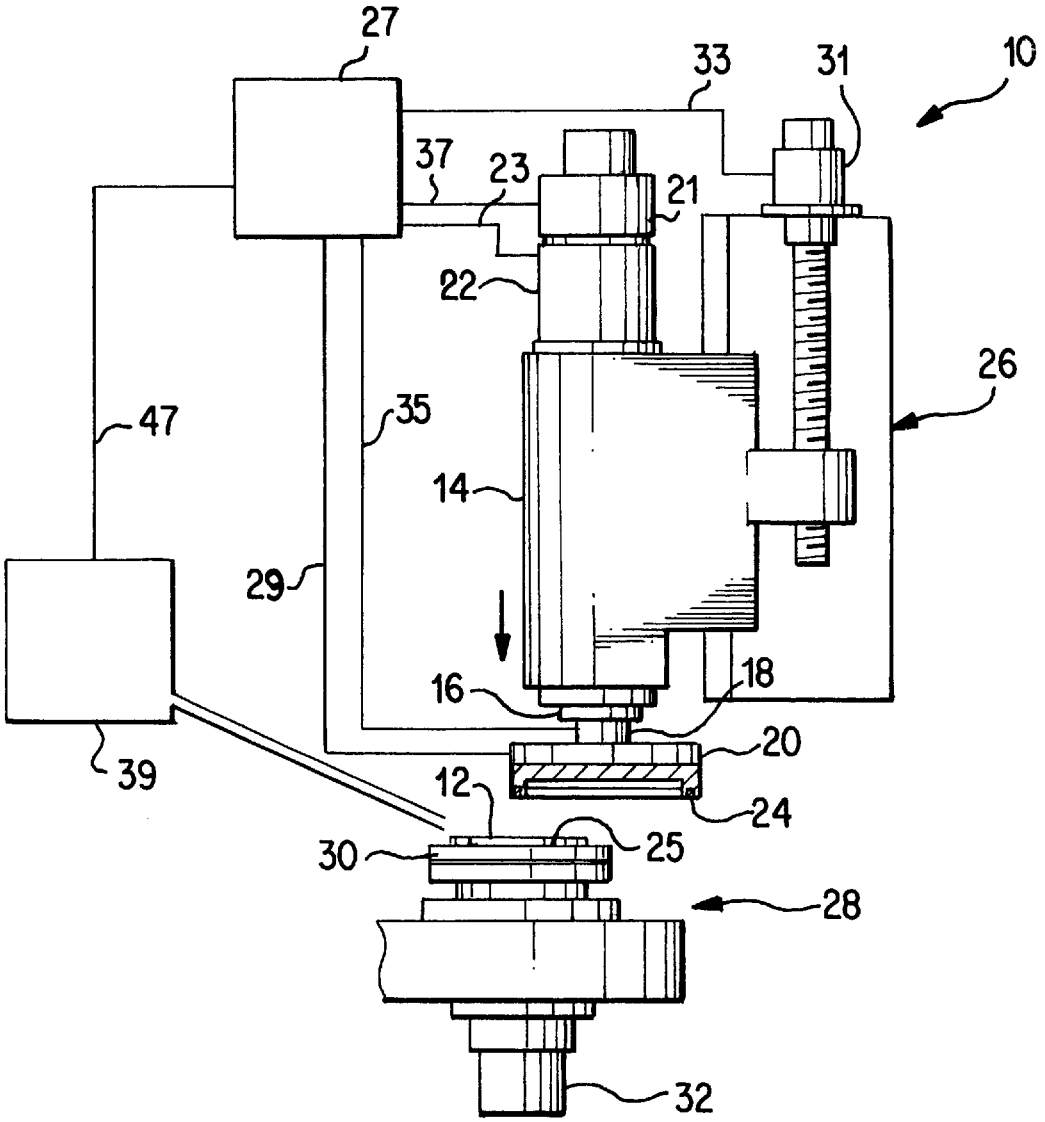
FIG. 1 illustrates a grinding machine according to the present invention.

FIG. 1 is a side view of a grinding machine 10 suitable for grinding a wafer 12. The grinding machine 10 includes a spindle housing 14. The spindle housing 14 includes a spindle 16 having a rotatable grinding shaft 18 and a grinding wheel 20 rigidly secured to the end of the shaft 18. A spindle motor 22 rotates the shaft 18 and thus, the grinding wheel 20 at conventional speeds of 2400–3000 RPM during the grinding process such that the grinding wheel 20 grinds away semiconductor material from the backside surface 25 of the wafer 12. The spindle housing 14 is secured to a conventional feed mechanism 26 such that the placement and feed rate of the grinding wheel 20 can be adjusted relative to the wafer 14 to provide different grinding rates.

A controller 27, such as a computer, is electrically connected to the grinding wheel 20 by electrical conductor 29 and to a feed rate motor 31 by electrical conductor 33. The controller 27 is further connected to a shaft speed sensor 19 (FIG. 5) by electrical conductor 35, to a spindle motor current detector 21 by electrical conductor 37, to the spindle motor 22 by electrical conductor 23 and to a source of wheel dressing 39 by electrical conductor 47.

The wafer 12 is secured to a chuck table 28 by a suitable securing mechanism, such as vacuum suction, as is well understood in the art, with the frontside of the wafer 12 that includes the integrated circuits positioned against the chuck table 28. The wafer 12 is secured to a chuck table platform 30, which in turn is secured to a shaft 32 which is driven by a chuck table motor (not shown) at conventional speeds of 50–300 RPM.

Figure 2:
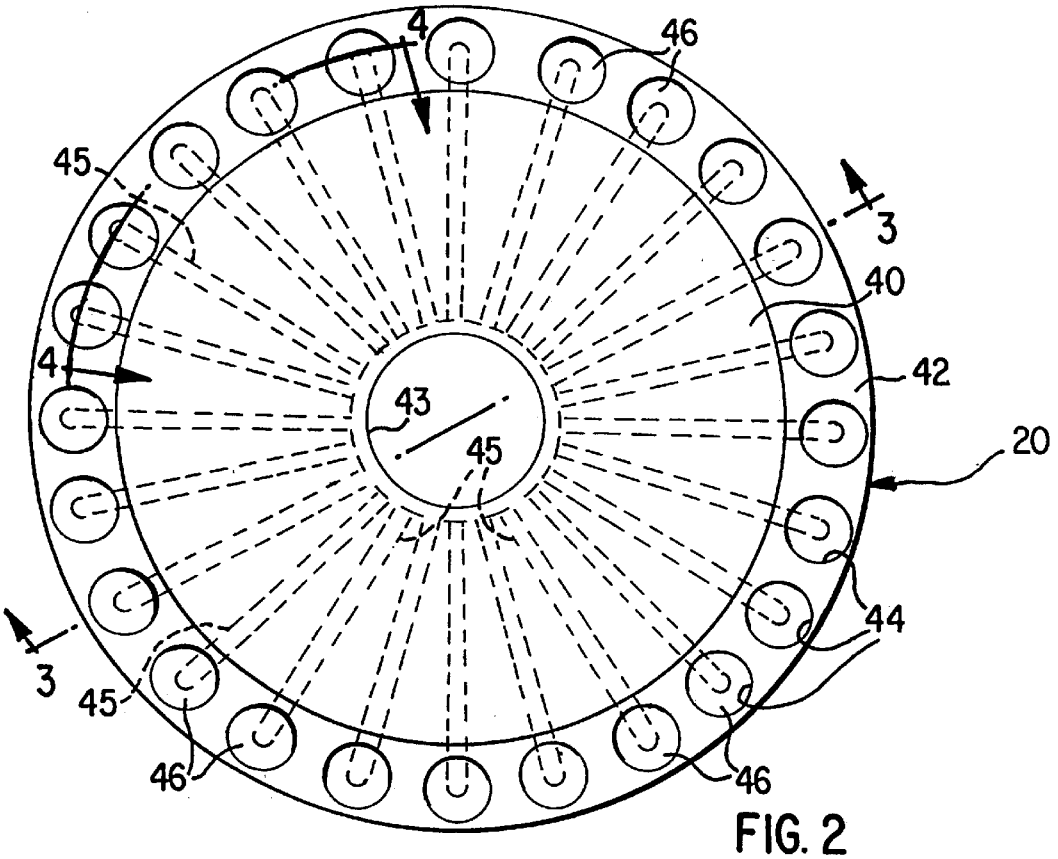
FIG. 2 is a bottom view of a grinding wheel showing a plurality of grinding teeth coupled to the grinding wheel.
Figure 3:
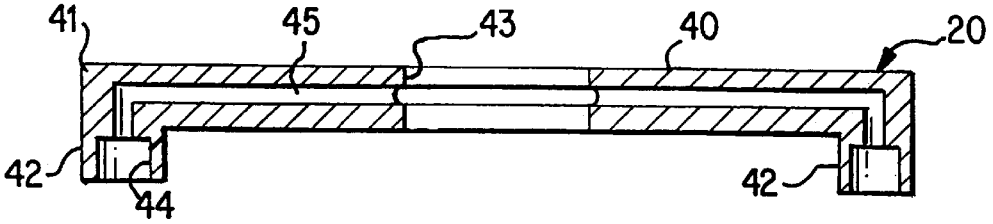
FIG. 3 is a section view taken along line 3—3 of FIG. 1 showing cavities and pressure signal pathways formed in the grinding wheel.
Figure 4:
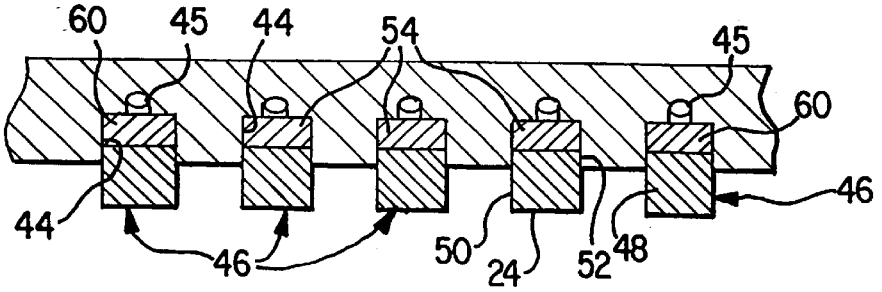
FIG. 4 is a section view of the grinding wheel taken along line 4—4 of FIG. 1.

As seen in FIGS. 2–4, the grinding wheel 20 according to the present invention includes a disk portion 40 and an annular shoulder 42 depending downwardly from the peripheral edge 41 of the disk portion 40. A plurality of cavities 44 are formed in the annular shoulder 42 and a grinding tooth 46 is disposed in each cavity 44. Each cavity 44 is connected to a central shaft-receiving bore 43 by a pressure signal transmission pathway 45.

Each grinding tooth 46 includes a body 48 having a first end 50, which includes the grinding surface 24, and a second end 52. The second end 52 is disposed in the cavity 44. A pressure sensor 54 is disposed in the cavity 44 between the second end 52 and the disk portion 40, as illustrated in FIG. 4.

The grinding surface 24 includes a plurality of diamonds suspended in a resinous binder. The binder is selected to be reactive with the wheel dressing and to dissolve, either mechanically, or chemically or both, as a result of the reaction. As the binder dissolves, the dull diamonds are released and washed away, leaving freshly exposed sharp diamonds. If will be appreciated by those of ordinary skill in the art that the wheel dressing can particularly include an abrasive slurry to improve the grinding process while removing binder material.

The pressure sensor 54 preferrably includes a piezoelectric element 60. The piezoelectric element 60 typically includes a crystal, such as quartz, that produces an electrical voltage when it is squeezed. In the present invention, the piezoelectric element 60 acts as a transducer to convert mechanical pressure on the grinding teeth 46 into an electrical signal. Thus, as the pressure exerted by the grinding wheel 20 against the wafer 12 is increased or decreased, an electrical signal from the piezoelectric element 60 increases or decreases.

Figure 5:
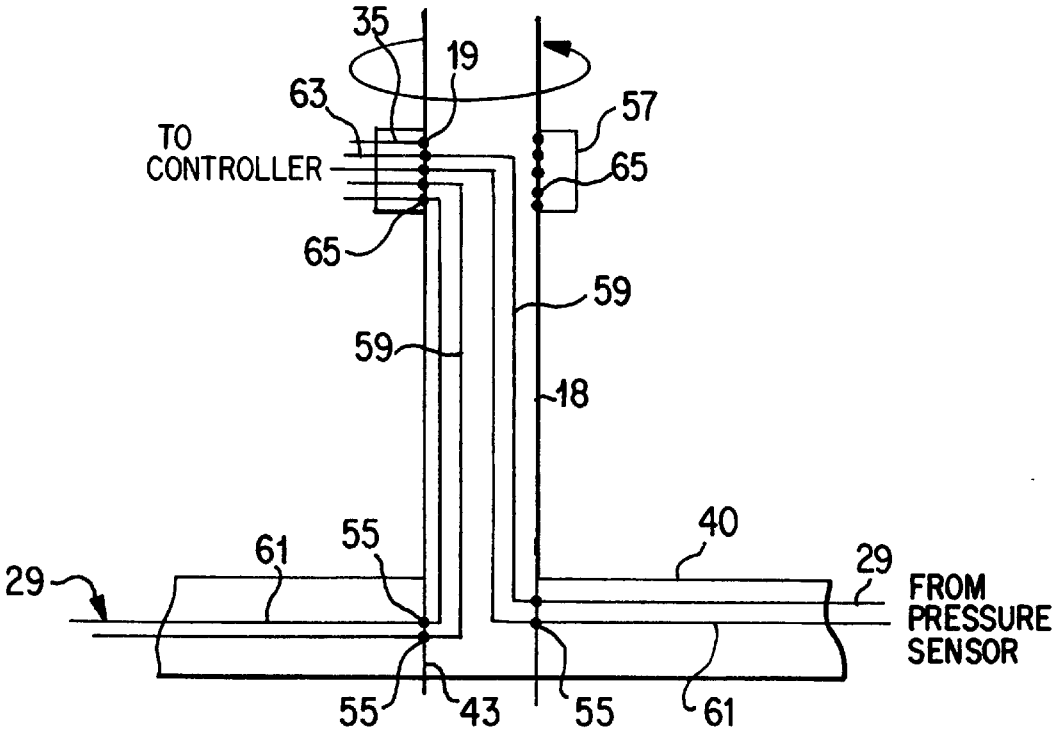
FIG. 5 illustrates a pressure signal pathway from the piezoelectric elements to the controller.

The pressure sensor 54 is electrically connected to the controller 27 by electrical conductor 29. In one embodiment, as illustrated in FIG. 5, electrical conductor 29 includes conductors 61 extending from the pressure sensors 54 to contacts 55 at the shaft-receiving bore 43. The contacts 55 are electrically connected, through electrical conductors 59 in the spindle shaft 18, to a pick-up collar 57. The pick-up collar 57 is electrically connected to the controller 27 by electrical conductors 63, which connect to conductors 59 at contacts 65, providing a pressure signal transmission pathway from the pressure sensors 54 to the controller 27. The pick-up collar 57 can also include the shaft speed sensor 19 for detecting the rotational speed of the shaft 18. Electrical conductor 35 connects the speed sensor 19 to the controller 27. It will be understood by those of ordinary skill that the sensor signals could be multiplexed to eliminate some of the electrical conductors, simplifying construction.

In operation, the feed rate motor 31 actuates the feed mechanism 26 to position the grinding wheel 20 near the backside surface 25 of the wafer 12. Then, with the grinding wheel 20 and the wafer 12 rotating at predetermined rates, but in opposite directions, the feed rate motor 31 moves the grinding wheel 20 at a predetermined feed rate into contact with the wafer 12 to grind the backside surface 25 of the wafer 12. As the pressure increases between the grinding wheel 20 and the wafer 12, the grinding teeth 46 are pushed up into the cavities 44, squeezing the piezoelectric elements 60 therein. As the piezoelectric elements 60 are compressed, they put out a signal via electrical conductor 29 to the controller 27 indicative of the amount of force being applied to them and, therefore, to the wafer 12.

The controller 27 also receives input signals from the speed sensor 19, indicative of the rotational speed of the shaft 18, via conductor 35 and from the current detector 21, indicating the amount of current draw of the spindle motor 22, via conductor 37. Based on the signals received, the controller 27 adjusts the release of wheel dressing by sending a control signal via electrical conductor 47 to the source of wheel dressing 39 to sharpen the grinding wheel 20.

Figure 9:
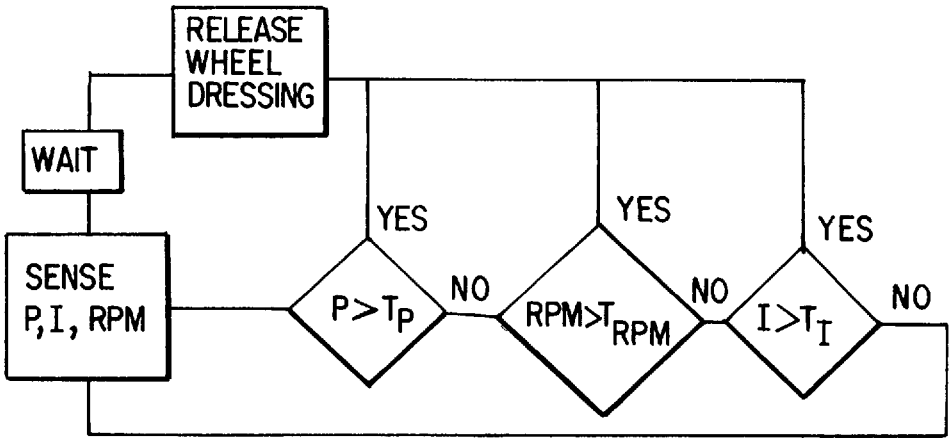
FIG. 9 is a flow diagram of a process for receiving inputs at the controller and controlling the release of wheel dressing.

There are several possible methods whereby the controller 27 can process the input signals. For example, as illustrated in FIG. 9, the controller can sense the pressure (P), spindle motor current (I), and shaft speed (RPM) and compare them to threshold values ($T_P$) , ($T_I$) , ($T_{RPM}$). The controller 27 compares the pressure (P) with the threshold pressure value ($T_P$) , and if the pressure is greater than the threshold value, the controller sends a signal to the wheel dressing source 39 to release wheel dressing. The controller 27 can then wait a predetermined amount of time until the wheel dressing has had an opportunity to sharpen the grinding wheel, at which time the controller 27 can receive new values for the pressure, current, and shaft speed. Once the pressure is less than, or equal to, the threshold pressure value, the controller 27 compares the RPM value with the threshold RPM value ($T_{RPM}$), a signal is sent to the source 39 to release more wheel dressing. Again, the controller 27 waits for the wheel dressing to sharpen the wheel and then takes new inputs. If the pressure (P) is less than, or equal to, the threshold value ($T_P$), and the shaft speed (RPM) is greater than or equal to the threshold value ($T_{RPM}$), the controller 27 compares the sensed current (I) with the threshold value ($T_I$). If the sensed valued (I) exceeds the threshold value ($T_I$), the controller 27 sends a signal to the source 39 to release wheel dressing. This sensing and dressing release process is continued repeatedly during the grinding process. It will be appreciated by those of ordinary skill in the art that the controller 27 could be limited to sensing and comparing the pressure, and need not sense the motor current (I) or shaft speed (RPM).

In an alternative control scheme, the controller 27 could sense the pressure (P), motor current (I), and shaft speed (RPM) and use one or more of those values as entering arguments in a look-up table or matrix. The table can contain theoretical or empirical data for an amount of wheel dressing to be released in the event of a given combination of sensed values. It will also be understood that each entering argument could be the difference between the sensed value and threshold value, or the status of the sensed value as falling inside or outside of a predetermined range of acceptable values.

As the wheel dressing reacts with the binder, the dull diamonds are washed away and replaced by freshly exposed sharp diamonds. The sharp diamonds will remove more material than the dull diamonds they replaced, and the shaft speed, spindle motor current and pressure will all change. The changes will be detected by the respective sensors and new signals reflecting the changed values will be sent to the controller 27. The controller 27 adjusts the feed rate and release of wheel dressing accordingly to maintain an optimum grinding action.

Figure 6:
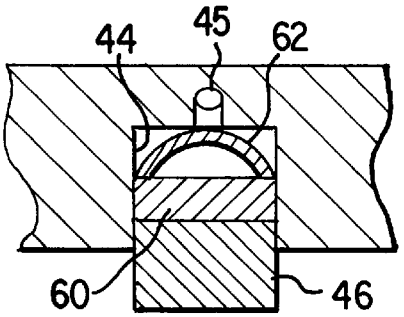
FIG. 6 is a section view taken through an alternative embodiment of the invention.

In an alternative embodiment of the invention, as illustrated in, FIG. 6, a leaf spring 62, or other resilient element, is inserted in the cavity 44 between the piezoelectric element 60 and the disk portion 40. The leaf spring 62 allows the grinding machine 10 to pick up an electrical signal from the piezoelectric element 60, while easing the forces applied to the wafer 12 during lift off by adjusting the feed rate. Reducing the applied downward forces in a slow controlled manner as the grinding machine completes the wafer grinding process results in a finer finish, increased die strength at sparkout or lift off, and reduced total thickness variation.

Figure 7:
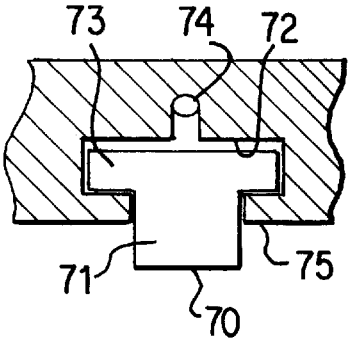
FIG. 7 is a section view taken through another alternative embodiment of the invention.
Figure 8:
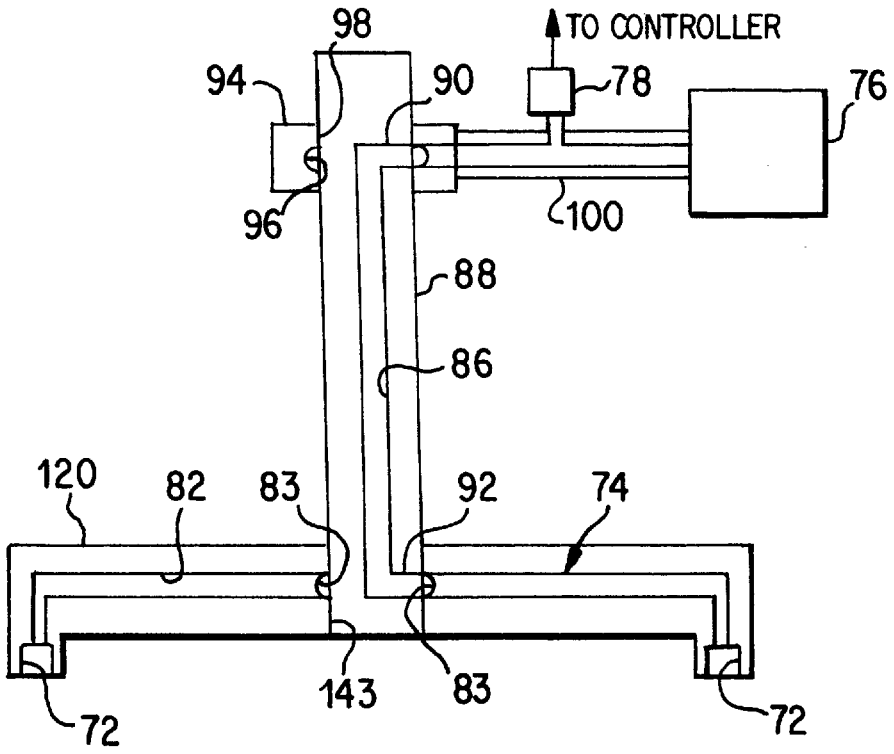
FIG. 8 illustrates a fluid pressure signal pathway between the cavities and a fluid source.

In yet another embodiment of the invention, a T-shaped tooth 70 having a base portion 71 and a cap portion 73 is disposed in a T-shape cavity 72 formed by an inwardly extending annular flange 75. As illustrated in FIGS. 7 and 8, pressure signal transmission pathway 74 includes a fluid-carrying conduit that connects the cavity 72 with a source 76 of fluid. The fluid provides the function of pressure sensing, with the pressure signal being transmitted through the pathway 74 to a pressure detector 78 that converts the hydraulic signal into an electrical signal for processing by a controller 27.

FIG. 8 illustrates the pathway 74 for a pressure signal from the cavities 72 to the controller 27. Fluid carrying bores 82 are formed in the grinding wheel 120 and extend from the shaft-receiving bore 143 to each cavity 72. The fluid-carrying bores 82 are fluidly connected to each other by a channel 83 formed in the grinding wheel 120 adjacent the shaft-receiving bore 143. An axially extending bore 86 is formed in the shaft 88 and includes an inlet 90 and an outlet 92. A fluid coupler 94 is rotatably coupled to the shaft 88 and extends therearound. The coupler 94 includes a channel 96 adjacent a central shaft-receiving bore 98 to ensure fluid contact with the inlet 90 regardless of the angular position of the shaft 88. The outlet 92 is positioned to open into the channel 83 formed in the grinding wheel 88. Thus, the cavities 72 are fluidly connected to the coupler 94. The coupler 94 is fluidly connected by conduit 100 to the fluid source 76. A pressure detector 78 taps into conduit 100 to detect fluid pressure in the conduit 100 and provide a pressure signal to the controller 27.

Advantageously, the fluid can be coolant used to cool the wafer 12 during the grinding process. In a non-grinding condition, the coolant fluid pushes the cap portion 73 of the tooth 70 against the flange 75 to substantially seal the cavity 72. As grinding begins, heat builds up on the wafer 12 and an increasing pressure is exerted against the tooth 70. As the pressure increases, the grinding tooth 70 is pushed up into the cavity 72, lifting the cap portion 73 away from the flange 75, allowing an increased flow of coolant out of the cavity 72. The increased flow of coolant fluid out of the cavity 72 is accompanied by a corresponding change in fluid pressure in the cavity 72. The pressure change is detected at the detector 78 and converted to an electrical signal indicative of the pressure applied by the grinding wheel 120 against the wafer 12 and sent to the controller 27.

Alternatively, the fluid can be wheel dressing. As the diamonds wear away, increasing pressure is applied against the wafer 12. The pressure pushes the teeth 70 up into the cavities 72, moving the cap portions 73 away from the flange 75, thereby releasing wheel dressing which sharpens the grinding wheel. The sharper grinding wheel removes more material and is better able to keep up with the feed rate, thereby reducing the pressure against the teeth 70 and allowing the teeth 70 to close off the cavities 72, stopping the flow of wheel dressing. While such mechanical release of wheel dressing is not as precise as when monitoring the pressure, shaft speed and motor current, it has the advantage of being simpler and cheaper.

The above descriptions and drawings are only illustrative of preferred embodiments which achieve the objects, features and advantages of the present invention, and it is not intended that the present invention be limited thereto. Any modification of the present invention which comes within the spirit and scope of the following claims is considered part of the present invention.

What is claimed as new and desired to be protected by Letters Patent of the United States is:

I claim:

1. A method for dressing a grinding wheel comprising the steps of:

moving a grinding wheel into contact with the wafer;

grinding the wafer;

receiving a signal indicative of a need to sharpen the grinding wheel; and controlling the release of wheel dressing to a contact area between the grinding wheel and wafer in response to the signal.

2. The method of claim 1 wherein the signal includes at least one of a signal indicative of pressure applied by the grinding wheel against the wafer, a signal indicative of the current draw of a motor drivingly coupled to the grinding wheel, and a signal indicative of a rotational speed of the grinding wheel.

3. The method of claim 2 wherein the grinding wheel includes a disk portion and a grinding surface, the signal indicative of pressure applied by the grinding wheel being generated by a pressure sensor disposed between the grinding surface and the disk portion.

4. A method for sharpening a wafer grinding wheel comprising the steps of:

providing a wafer grinding wheel having grinding material suspended in a binder;

grinding the wafer with the grinding wheel;

receiving a signal indicative of resistance to grinding; and releasing wheel dressing to a contact area between the grinding wheel and wafer in response to the signal.

5. The method of claim 4 wherein the signal includes at least one of a first input indicative of a current draw of a drive motor coupled to a shaft for driving the grinding wheel, a second input indicative of the speed of the shaft, and a third input indicative of pressure applied by the grinding wheel against the wafer.

6. The method of claim 4 wherein the grinding material includes a plurality of partially exposed diamonds and a plurality of unexposed diamonds, the exposed diamonds being dulled during the grinding step and removed with a portion of the binder during the releasing step, a portion of the unexposed diamonds being thereby exposed.

7. A method for dressing a grinding wheel comprising the steps of:

providing a pressure sensing grinding wheel;

grinding the wafer with the grinding wheel, the grinding wheel applying pressure against the wafer during grinding; and releasing wheel dressing in response to pressure sensed by the grinding wheel.

8. The method of claim 7 wherein the grinding wheel includes a disk portion and an annular shoulder depending from the disk portion, the annular shoulder including a plurality of cavities, and a plurality of grinding teeth disposed in the plurality of cavities, the grinding teeth being pushed into their respective cavities in response to the pressure and releasing wheel dressing from the cavities.

9. A method for dressing a grinding wheel comprising the steps of:

providing a grinding wheel having a disk portion and an annular portion depending from the disk portion, the annular portion including a plurality of cavities and a plurality of grinding teeth disposed in the plurality of cavities, each tooth including a grinding surface and being movable in its respective cavity in response to pressure applied by the grinding wheel against the wafer; and providing a source of wheel dressing fluidly coupled to the plurality of cavities to supply wheel dressing to the plurality of cavities, wherein movement of a tooth in its respective cavity releases wheel dressing from the respective cavity to dress the grinding wheel.

10. A grinding machine for grinding a wafer comprising:

a rotating pressure sensing grinding wheel;

a source of wheel dressing; and a control system for releasing the wheel dressing in response to pressure sensed by the grinding wheel.

11. The grinding machine of claim 10 wherein said a controller is coupled to the source of wheel dressing and configured to receive a pressure signal from the grinding wheel, the controller sending a control signal to the source of wheel dressing in response to the pressure signal to cause a release of wheel dressing.

12. The grinding machine of claim 10 further including a shaft coupled to the grinding wheel, a grinding wheel drive motor coupled to the shaft, a shaft speed sensor, a drive motor current detector, and a pressure sensor disposed in the grinding wheel, the controller receiving input signals from at least one of the speed sensor, the current detector, and the pressure sensor, and providing a control signal to the source of wheel dressing in response to the input signals.

13. The grinding machine of claim 12 wherein the grinding material includes a plurality of diamonds suspended in the binder, a first portion of the plurality of diamonds being exposed for grinding and a second portion of the plurality of diamonds being unexposed, the first portion being worn down during grinding, the wheel dressing removing a portion of the binder and carrying away the worn down first portion and exposing the second portion.

14. A grinding machine for grinding a wafer comprising:

a grinding wheel including a disk portion and a grinding surface and a pressure sensor disposed between the disc portion and the grinding surface; and a source of wheel dressing, the wheel dressing being released in response to a pressure signal from the pressure sensor.

15. The grinding machine of claim 14 wherein the grinding wheel includes an annular shoulder depending from the peripheral edge of the disk portion and having at least one cavity and at least one grinding tooth disposed in the at least one cavity, the pressure sensor including at least one pressure sensor disposed in the at least one cavity between the at least one grinding tooth and the disk portion.

16. A grinding machine for grinding a wafer comprising:

a grinding wheel including a grinding surface having a grinding material suspended in a binder, the grinding material including a plurality of diamonds, a first portion of the plurality of diamonds being exposed for grinding and a second portion of the plurality of diamonds being unexposed, the exposed diamonds being worn during grinding;

a shaft rigidly coupled to the grinding wheel;

a grinding wheel drive motor coupled to the shaft;

a source of wheel dressing; and a controller coupled to the source of wheel dressing and configured to receive at least one of a first input indicative of a current draw of the motor, a second input indicative of the speed of the shaft, and a third input indicative of pressure sensed by the grinding wheel, the controller providing a signal to the source of wheel dressing to control the release of wheel dressing in response to the at least one of the first, second and third inputs.

17. A wafer grinding machine comprising:

a grinding wheel having a disk portion and an annular portion depending from the disk portion, the annular portion including a plurality of cavities and a plurality of grinding teeth disposed in the plurality of cavities, each tooth including a grinding surface and being movable in its respective cavity in response to pressure sensed by the grinding wheel; and a source of wheel dressing fluidly coupled to the plurality of cavities to supply wheel dressing to the plurality of cavities, wherein movement of a tooth in its respective cavity releases wheel dressing from the respective cavity.

18. The grinding machine of claim 17 wherein the plurality of grinding teeth includes a T-shaped tooth having a base portion and a cap portion and the plurality of cavities includes a cavity having an inwardly extending flange to engage the cap portion of the T-shaped tooth, the tooth being movable between a first position, wherein the cap portion engages the flange to seal the cavity and a second position, wherein the cap portion is disposed in a spaced apart relation to the flange to allow wheel dressing to flow out of the cavity.

* * * * *